US008935053B2

(12) United States Patent
Wheeler et al.

(10) Patent No.: US 8,935,053 B2
(45) Date of Patent: Jan. 13, 2015

(54) POWER RELEASE HOOD LATCH METHOD AND SYSTEM

(71) Applicant: Tesla Motors, Inc., Palo Alto, CA (US)

(72) Inventors: David Wheeler, San Carlos, CA (US); Brenda Cucci, San Carlos, CA (US); Adam S. Kilgore, San Francisco, CA (US); Dan Adams, Palo Alto, CA (US); Robert B. Mooney, Mountain View, CA (US)

(73) Assignee: Tesla Motors, Inc., Palo Alto, CA (US)

( * ) Notice: Subject to any disclaimer, the term of this patent is extended or adjusted under 35 U.S.C. 154(b) by 41 days.

(21) Appl. No.: 13/629,597

(22) Filed: Sep. 27, 2012

(65) Prior Publication Data

US 2014/0088826 A1 Mar. 27, 2014

Related U.S. Application Data

(60) Provisional application No. 61/539,708, filed on Sep. 27, 2011.

(51) Int. Cl.
*E05B 83/24* (2014.01)
*E05B 77/54* (2014.01)
*E05B 81/14* (2014.01)

(52) U.S. Cl.
CPC ..... *E05B 83/24* (2013.01); *E05B 77/54* (2013.01); *E05B 81/14* (2013.01)
USPC ..... 701/45; 701/36; 70/241; 361/170

(58) Field of Classification Search
CPC combination set(s) only.
See application file for complete search history.

(56) References Cited

U.S. PATENT DOCUMENTS

| | | | | |
|---|---|---|---|---|
| 5,853,060 | A * | 12/1998 | Chao et al. | 180/69.2 |
| 6,293,362 | B1 * | 9/2001 | Sasaki et al. | 180/274 |
| 2002/0196131 | A1 * | 12/2002 | McCarthy et al. | 340/425.5 |
| 2007/0216170 | A1 * | 9/2007 | Drescher et al. | 292/201 |
| 2013/0049403 | A1 * | 2/2013 | Fannon et al. | 296/193.11 |

FOREIGN PATENT DOCUMENTS

JP 2005238985 A * 9/2005

OTHER PUBLICATIONS

JP 2005238985 A, Sep. 8, 2005, Japan, Morishita, Human Translation.*

* cited by examiner

*Primary Examiner* — John R Olszewski
*Assistant Examiner* — Gerrad A Foster
(74) *Attorney, Agent, or Firm* — J. Richard Soderberg

(57) ABSTRACT

Aspects of the disclosure provide for controlling a hood latch using an electrically actuated primary hood latch and an electrically actuated secondary hood latch. To open the hood of the vehicle, a person presses a hood release button. Before attempting to release either the primary hood latch or secondary hood latch, a determination is made whether a vehicle speed of the vehicle is below a minimum vehicle speed threshold. If the vehicle speed is below this threshold, both the primary electrical actuator for the primary hood latch and the secondary electrical actuator for the secondary hood latch are triggered, thereby releasing hood from a closed position into an open position. When the vehicle speed is above this vehicle speed threshold, only the primary electrical actuator for primary hood latch is triggered; leaving the hood in a partially open position held in place by the secondary hood latch.

10 Claims, 4 Drawing Sheets

POWER RELEASE HOOD LATCH METHOD AND SYSTEM

CROSS-REFERENCE TO RELATED APPLICATIONS

This application claims the benefit of: U.S. Provisional Application No. 61/539,708, filed Sep. 27, 2011, entitled, "POWER RELEASE HOOD LATCH" by Cucci et. al, assigned to the assignee of this application and incorporated by reference herein for all purposes.

TECHNICAL FIELD

The subject matter described herein concerns features used on a vehicle, and more particularly to a hood latch and methods for releasing the hood latch.

DESCRIPTION OF THE RELATED ART

A hood latch secures the hood of a vehicle in place. In some vehicles, the hood covers an engine compartment while in other vehicles the hood covers a trunk area used for storage. For safety reasons, the hood is generally held in a closed position using a primary hood latch and a secondary hood latch. To open the hood, conventional solutions first require a person in the vehicle to release the primary hood latch by operating a first mechanical release within the vehicle. Releasing the primary hood latch allows the hood to lift a few inches and become partially open.

The secondary hood latch, which operates independently from the primary hood latch, remains latched to the hood and keeps the partially opened hood from opening completely. By operating a second mechanical release outside the vehicle, typically under the partially opened hood, the person can release the secondary hood latch and allow the hood to open completely.

While it is desirable to have two hood latches secure the hood, it is sometimes inconvenient for the driver to open the primary hood latch from within the vehicle and then get out of the vehicle to open the secondary hood latch. This is particularly true when the hood is covering a storage area that can be used for storing groceries, books, sports equipment or other readily accessible items.

SUMMARY

Aspects of the disclosure provide a method of controlling a hood latch on a vehicle using both an electrically actuated primary hood latch and an electrically actuated secondary hood latch. Initially, a person presses a hood release button, such as on a wireless hood release or key fob, and requests to open the hood of the vehicle, Before attempting to release either the primary hood latch or secondary hood latch, a determination is made whether a vehicle speed associated with the vehicle is below a minimum vehicle speed threshold, in some cases below 1 mph. If the vehicle speed is below the minimum vehicle speed threshold, both the primary electrical actuator for the primary hood latch and the secondary electrical actuator for the secondary hood latch are triggered, thereby releasing hood from a closed position into an open position. When the vehicle speed is above this vehicle speed threshold, only the primary electrical actuator for primary hood latch is triggered; this leaves the hood in a partially open position held in place by the secondary hood latch.

DETAILED DESCRIPTION

In the following detailed description, for purposes of explanation, numerous specific details are set forth to provide a thorough understanding of the various embodiments of the disclosure. Those of ordinary skill in the art will realize that these various embodiments are illustrative only and are not intended to be limiting in any way. Other embodiments will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual implementation, numerous implementation-specific decisions may be required to achieve specific design objectives. These design objectives will vary from one implementation to another and from one developer to another, Moreover, it will be appreciated that such a development effort might be complex and time-consuming but would nevertheless be a routine engineering undertaking for those of ordinary skill in the art having the benefit of this disclosure.

Figure 1A:
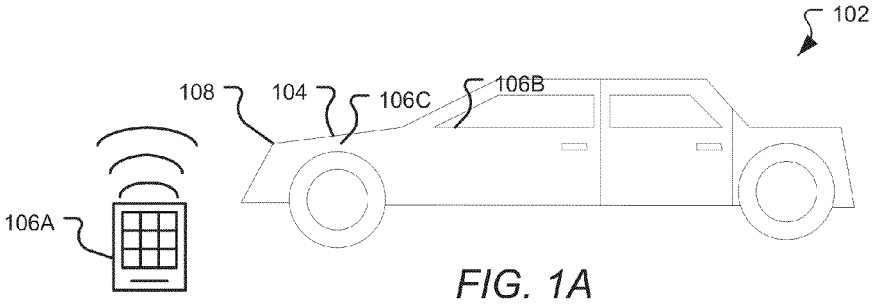
FIGS. 1A-1C provides an exterior view of a vehicle with a hood dosed, partially-open, and open position in accordance with some embodiments.
Figure 1B:
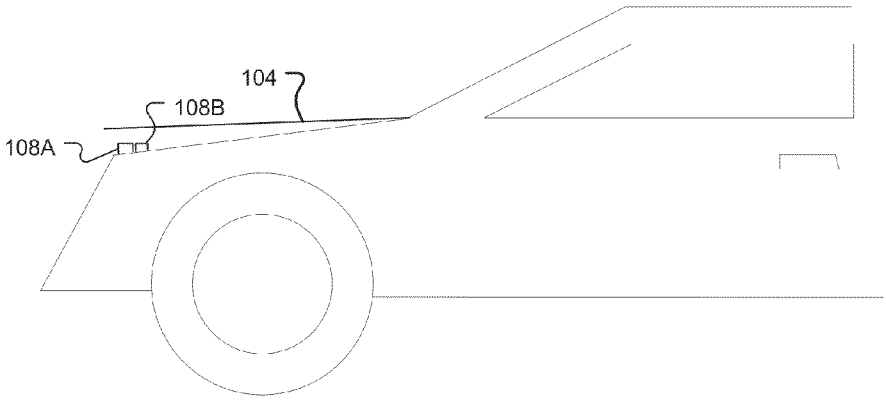
Figure 1C:
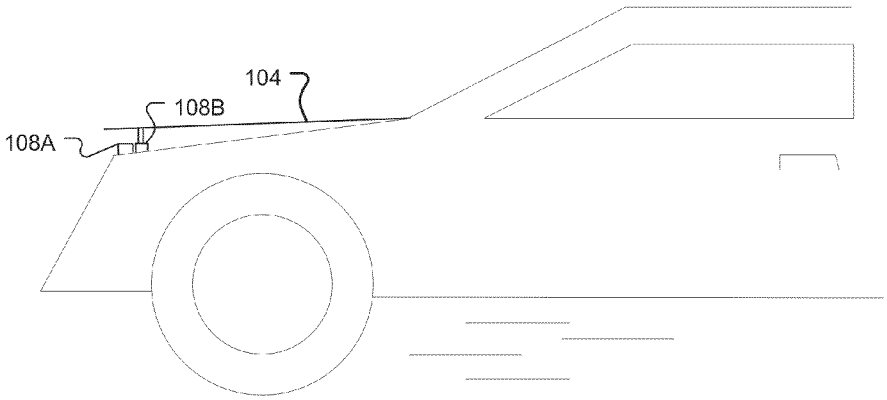

Referring to FIG. 1A-1C, a vehicle is illustrated having a hood latch system that controls the opening of the hood in accordance with some embodiments, Vehicle 102, as illustrated, includes a hood 104 covering a storage area or engine area, a hood latching system 108, and several mechanisms for releasing the hood: a wireless hood release 106A, a console hood release 106B, and a trunk interior hood release 106G. In some embodiments, each of these hood releases 106A-106C are operated with a button that, in turn, electrically actuates the hood latching system and attempts to open the hood. Alternate embodiments may also include a conventional mechanical release for a primary hood latch in the event the battery from the vehicle used to operate the hood latching system has an insufficient charge.

Wireless hood release 106A in FIG. 1A allows a person outside of the vehicle to press a button on a key fob or similar device and open the front trunk. This may be useful when a person would like to store some items in the front trunk of the vehicle 102 without first entering the vehicle. The console hood release 106B, located in the interior of the vehicle, may be a button located on the console or a button on a touch-panel display for the vehicle. A person may remain inside the vehicle 102 while using the console hood release 106B to open the hood for a person outside the vehicle. The trunk interior hood release 106C, located on the interior area under the hood, is used to open the hood by a person accidentally locked inside the front trunk.

While the vehicle is not moving, operating one of hood releases 106A-C electrically actuates both a primary hood latch 108A and a secondary hood latch 108B and allows the hood 104 to be opened. As illustrated in FIG. 1B, the vehicle 102 is not moving and both the primary hood latch 108A and secondary hood latch 108B have both been actuated thereby opening the hood 104. In contrast, the vehicle 102 is moving in FIG. 1C and only the primary hood latch 108A is actuated thereby leaving the hood 104 partially opened; the secondary hood latch 108B remains engaged and holds the hood from opening completely.

Figure 2A:
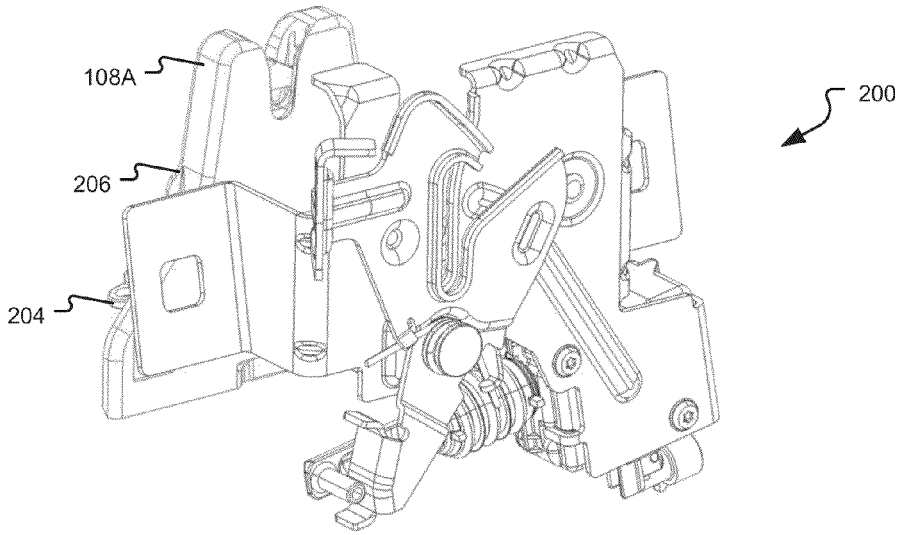
FIGS. 2A-2B provides a perspective view of a hood latching system with a primary hood latch and a secondary hood latch in accordance with some embodiments.
Figure 2B:
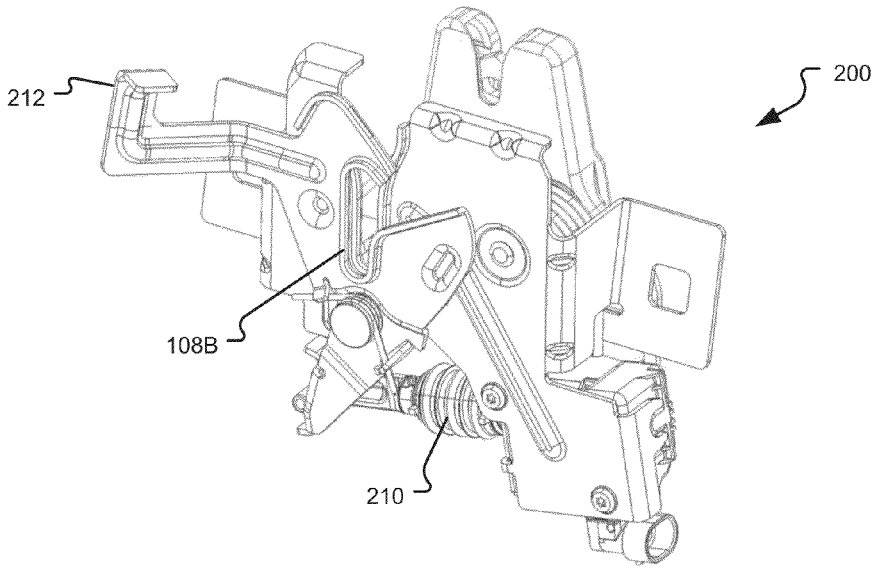

FIGS. 2A-2B provide a perspective view of a hood latching system 200 with a primary hood latch and a secondary hood latch in accordance with some embodiments. In this embodiment, primary hood latch 108A has a mechanical actuator 204 and an electrical actuator 206 capable of releasing primary hood latch 108A. The mechanical actuator 204 for the primary hood latch 108A may be operated from a lever or similar device from within the interior of the vehicle. Similarly, secondary hood latch 108B has a mechanical actuator 212 and a electrical actuator 210 capable of releasing secondary hood latch 108B. Typically, the mechanical actuator 212 for the secondary hood latch 108B is operated from outside the vehicle and is accessible just under the partially opened hood.

Figure 3:
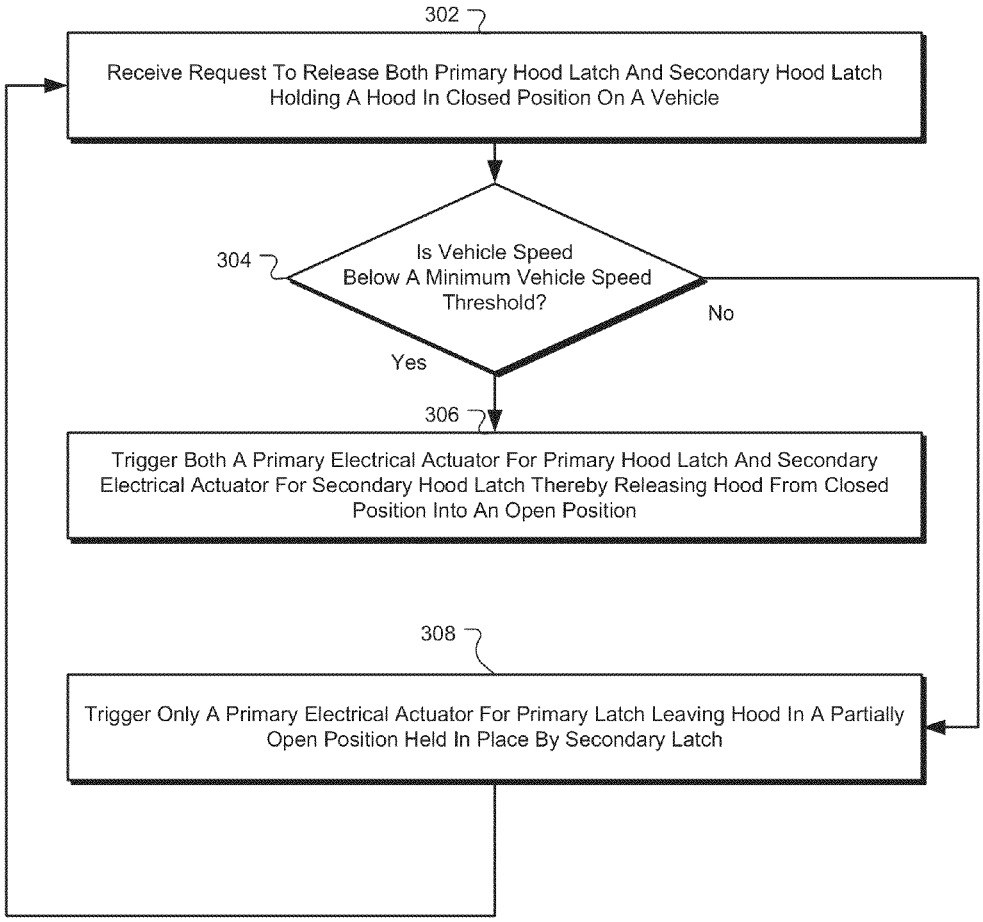
FIG. 3 provides a flowchart diagram overview of the operations associated with electrically activating both a primary hood latch and secondary hood latch in accordance with some embodiments.

FIG. 3 provides a flowchart diagram overview of the operations associated with electrically actuating both a primary hood latch 108A and secondary hood latch 108B in accordance with some embodiments. Initially, the hood 104 is closed over an engine compartment or front trunk and both the primary hood latch 108A and secondary hood latch 108B are engaged and holding the hood in position. Subsequently, one embodiment receives a request to release both a primary hood latch and a secondary hood latch holding the hood in closed position. (302) For example, this request may be received from wireless hood release 106A, console hood release 106B, or a trunk interior hood release 106C.

The request does not immediately release the hood; instead some embodiments first determine if the vehicle is traveling below a minimum vehicle speed threshold. (304) The vehicle minimum threshold may be set to no greater than 1 mph, 5 km/h, or any other speed deemed to be safe for opening the hood. In the event the vehicle is traveling at or below this vehicle minimum threshold (304-Yes), both a primary electrical actuator for the primary hood latch and a secondary electrical actuator for the secondary hood latch are triggered thereby releasing the hood from a closed position into an open postion, (306) As illustrated in FIGS. 2A-2B, some embodiments of hood latching system 200 have an electrical actuator 206 capable of releasing primary hood latch 108A and an electrical actuator 210 capable of releasing secondary hood latch 108B.

When the vehicle is moving above the minimum vehicle speed threshold (304-No), the primary electrical actuator triggers the primary hood latch and leaves the hood in a partially open position held in place by secondary hood latch. (308) The partially open hood may be open 2-3 inches but cannot open further until the secondary hood latch is mechanically actuated, or electrically actuated when the car speed drops below the vehicle speed threshold.

Figure 4:
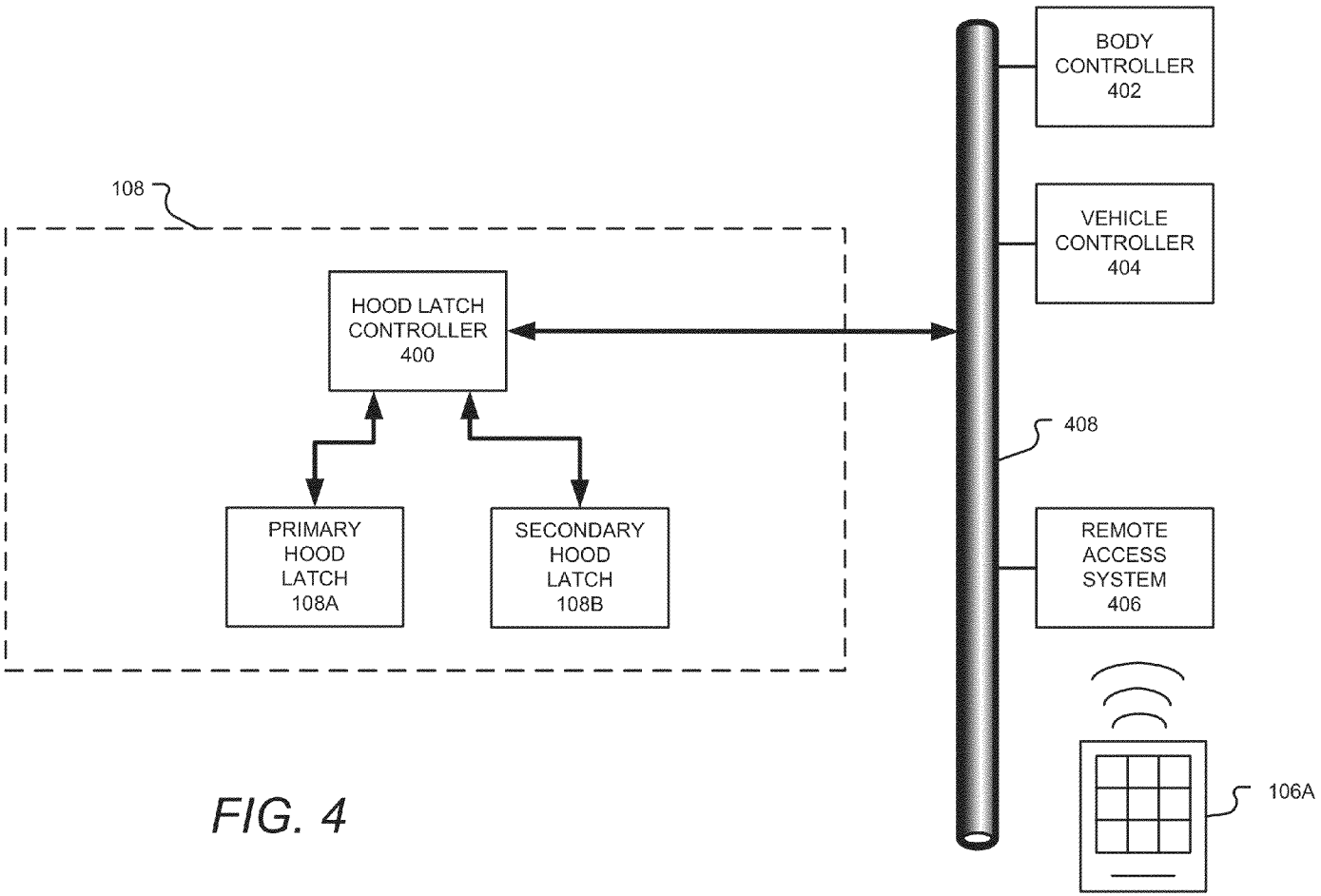
FIG. 4 schematically illustrates systems and electronics supporting operation of a hood latching system in accordance with some embodiments.

FIG. 4 schematically illustrates systems and electronics supporting operation of a hood latching system 108 in accordance with some embodiments. An apparatus can include a processor, and a memory containing instructions that when executed on the processor cause the processor to perform operations. As illustrated, these systems may include hood latch controller 400, a body controller 402, a vehicle controller 404, a remote access system 406, a wireless controller 106A communicating over a communication bus 408. In operation, a person presses a button on a hood release, such as wireless hood release 106A, to open the hood of the vehicle. In the case of wireless hood release 106A, the request is received and processed by remote access system 406 to ensure the wireless hood release 106A is authorized to make the request. Once authorized, the request is further processed by body controller 402 to ensure the vehicle is not moving faster than the minimum vehicle threshold. Vehicle speed information gathered by vehicle controller 404 is sent to body controller 402 to determine if only the primary hood latch 108A should be released or both the primary hood latch 108A and the secondary hood latch 1088. If the vehicle speed is at or below the minimum vehicle threshold, a signal is passed to the hood latch controller 400 to electrically actuate both the primary hood latch 108A and the secondary hood latch 108B and open the hood. When the vehicle speed is above the minimum vehicle threshold, a signal is passed to the hood latch controller 400 to electrically actuate only the primary hood latch 108A and leave the hood only partially open.

While specific embodiments have been described herein for purposes of illustration, various modifications may be made without departing from the spirit and scope of the disclosure. Accordingly, the disclosure is not limited to the above-described implementations, but instead is defined by the appended claims in light of their full scope of equivalents.

What is claimed is:

1. A method of controlling a hood latch on a vehicle, comprising:

receiving, in a processor, an electronic request to release both a primary hood latch and a secondary hood latch holding a hood in a closed position on a vehicle, the primary hood latch configured for actuation by a primary electrical actuator as well as by a primary mechanical actuator, the secondary hood latch configured for actuation by a secondary electrical actuator as well as by a secondary mechanical actuator;

in response to the electronic request, determining whether a vehicle speed associated with the vehicle is below a minimum vehicle speed threshold;

in response to determining that the vehicle speed is below the minimum vehicle speed threshold, triggering by the processor, both (i) the primary electrical actuator for the primary hood latch without actuation by the primary mechanical actuator, and (ii) the secondary electrical actuator for the secondary hood latch without actuation by the secondary mechanical actuator, thereby releasing the hood from the closed position into an open position; and in response to determining that the vehicle speed is not below the minimum vehicle speed threshold, triggering by the processor, only the primary electrical actuator for the primary hood latch without actuation by the primary mechanical actuator, leaving the hood in a partially open position held in place by the secondary hood latch, wherein the hood remains in the partially open position and does not electrically actuate until the electronic request is again received when the vehicle speed is below the minimum vehicle speed threshold;

wherein the primary and secondary mechanical actuators are configured for actuation of the primary and secondary hood latches regardless of the vehicle speed.

2. The method of claim 1 wherein the electronic request to release both the primary hood latch and the secondary hood latch is transmitted from a hood release selected from a set of hood release including a wireless hood release and a console hood release.

3. The method of claim 1 wherein the minimum vehicle speed threshold is less than 1 mph.

4. The method of claim 1 wherein the hood covers an engine compartment.

5. The method of claim 1 wherein the hood covers a trunk area for storage.

6. An apparatus for controlling a hood latch on a vehicle, comprising:

a processor; and a memory containing instructions that when executed on the processor cause the processor to:

receive an electronic request to release both a primary hood latch and a secondary hood latch holding a hood in a closed position on a vehicle, the primary hood latch configured for actuation by a primary electrical actuator as well as by a primary mechanical actuator, the secondary hood latch configured for actuation by a secondary electrical actuator as well as by a secondary mechanical actuator;

in response to the electronic request, determine whether a vehicle speed associated with the vehicle is below a minimum vehicle speed threshold;

in response to the determination that the vehicle speed is below the minimum vehicle speed threshold, trigger both (i) the primary electrical actuator for the primary hood latch without actuation by the primary mechanical actuator, and (ii) the secondary electrical actuator for the secondary hood latch without actuation by the secondary mechanical actuator, thereby releasing the hood from the closed position into an open position; and in response to determining that the vehicle speed is not below the minimum vehicle speed threshold, trigger only the primary electrical actuator for the primary hood latch without actuation by the primary mechanical actuator, leaving the hood in a partially open position held in place by the secondary hood latch, wherein the hood remains in the partially open position and does not electrically actuate until the electronic request is again received when the vehicle speed is below the minimum vehicle speed threshold;

wherein the primary and secondary mechanical actuators are configured for actuation of the primary and secondary hood latches regardless of the vehicle speed.

7. The apparatus of claim 6 wherein the electronic request to release both the primary hood latch and the secondary hood latch is transmitted from a hood release selected from a set of hood release including a wireless hood release and a console hood release.

8. The apparatus of claim 6 wherein the minimum vehicle speed threshold is less than 1 mph.

9. The apparatus of claim 6 wherein the hood covers an engine compartment.

10. The apparatus of claim 6 wherein the hood covers a trunk area for storage.

* * * * *